US011576533B1

(12) United States Patent
Branch et al.

(10) Patent No.: US 11,576,533 B1
(45) Date of Patent: Feb. 14, 2023

(54) ADJUSTABLE SHOWER ASSEMBLY

(71) Applicants: Dona Branch, Sugar Hill, GA (US); Eric Young, Sugar Hill, GA (US)

(72) Inventors: Dona Branch, Sugar Hill, GA (US); Eric Young, Sugar Hill, GA (US)

( * ) Notice: Subject to any disclaimer, the term of this patent is extended or adjusted under 35 U.S.C. 154(b) by 0 days.

(21) Appl. No.: 17/392,107

(22) Filed: Aug. 2, 2021

(51) Int. Cl.
*A47K 3/28* (2006.01)
*A47K 5/02* (2006.01)

(52) U.S. Cl.
CPC ..... *A47K 3/282* (2013.01); *A47K 5/02* (2013.01)

(58) Field of Classification Search
USPC ..... 4/611
See application file for complete search history.

(56) References Cited

U.S. PATENT DOCUMENTS 5,329,651 A 7/1994 Mardero et al.
5,465,437 A * 11/1995 Herman ..... A47K 3/282 4/604
6,042,178 A * 3/2000 Hetherington ..... A47C 9/06 297/14
6,094,756 A * 8/2000 Carter ..... A47K 3/282 4/575.1
2015/0208873 A1* 7/2015 Tessier ..... A47K 3/122 4/615
2020/0146513 A1 5/2020 Lee et al.

FOREIGN PATENT DOCUMENTS

| | | | |
|---|---|---|---|
| JP | 2019202129 | A | 11/2019 |
| JP | 2020127679 | A | 8/2020 |
| JP | 2020127680 | A | 8/2020 |
| KR | 1020170088245 | A | 8/2017 |
| KR | 101908213 | B1 | 10/2018 |
| WO | 2018143878 | A1 | 8/2018 |

* cited by examiner

*Primary Examiner* — Huyen D Le
(74) *Attorney, Agent, or Firm* — Bekiares Eliezer LLP

(57) ABSTRACT

A shower assembly apparatus may include a main body that is removably installed in a bathtub. The main body includes a first mounting point and a second mounting point, separated by a spacing member. The main body includes an adjustable seat subassembly that may be interchangeably mounted at either the first or second mounting point. The adjustable seat assembly includes an adjustable-support tower and a seat attached thereto. The main body includes a handle subassembly that may be interchangeably mounted at either the first or second mounting point. The handle subassembly and the adjustable seat subassembly are configured such that the subassemblies are mounted at different mounting points of the main assembly, but may be changed between mounting points as needed. The spacing member of the main assembly may be positioned at a distal side of the bathtub relative to a bathtub entry point.

20 Claims, 4 Drawing Sheets

ADJUSTABLE SHOWER ASSEMBLY

RELATED APPLICATION

This patent application is related to U.S. Design application No. 29/802,011 filed on Aug. 2, 2021, entitled "ADJUSTABLE SHOWER ASSEMBLY". The aforementioned patent application is expressly incorporated herein, in its entirety, by reference.

FIELD OF DISCLOSURE

The present disclosure generally relates to shower chair assemblies.

BACKGROUND

Bathing is an important part of a regular routine, for hygiene purposes, improving skin integrity, and allowing for wounds and breaks in the skin to heal more quickly and safely. However, some individuals may find it difficult or impossible to stand for prolonged periods of time in order to take a shower.

Health care workers can and often do provide shower assistance. However, shower assistance can be invasive, and some view the presence of a health care worker during bathing as invasive or undignified.

Shower chairs and benches are available for use in the shower as well. Conventional shower chairs and benches include a (typically white) bench seat, supported by four legs in a chair. However, the chair legs often serve as a tripping hazard. Moreover, the bench seat is not ideal for showering. The seat does not provide the user with the ability to wash or rinse the user's undercarriage. Moreover, a white seat may be difficult for vision-impaired users to see in the shower, particularly if corrective lenses are removed for bathing. Still further, while a conventional shower chair may provide a user with a place to sit during the shower, it does not aid the user in bathing, as a conventional shower chair or bench does not offer the user a location to store hygiene products, such as soap, shampoo, a razor, a toothbrush, and the like.

BRIEF OVERVIEW

This brief overview is provided to introduce a selection of concepts in a simplified form that are further described below in the Detailed Description. This brief overview is not intended to identify key features or essential features of the claimed subject matter. Nor is this brief overview intended to be used to limit the claimed subject matter's scope.

A shower assembly apparatus may be configured to be removably installed into a bathtub. In embodiments, the shower assembly includes a main body or assembly that may be removably installed in the bathtub. The main assembly may include at least a first mounting point and a second mounting point, separated by a spacing member.

The shower assembly may include an adjustable seat subassembly configured to be interchangeably mounted at either the first mounting point or the second mounting point. In embodiments, the adjustable seat assembly may include an adjustable-height support tower and a seat configured to be attachable to the support tower.

The shower assembly may include a handle subassembly configured to be interchangeably mounted at either the first mounting point or the second mounting point. The handle subassembly and the adjustable seat subassembly are configured such that the subassemblies are mounted at different mounting points of the main assembly. However, the subassemblies can be changed between mounting points as needed to meet, for example, user preferences and/or bathtub layouts.

The spacing member of the main assembly may be positioned at a first side of the base, such that the spacing member is at a distal side of the bathtub relative to a point of entry into the bathtub.

Both the foregoing brief overview and the following detailed description provide examples and are explanatory only. Accordingly, the foregoing brief overview and the following detailed description should not be considered to be restrictive. Further, features or variations may be provided in addition to those set forth herein. For example, embodiments may be directed to various feature combinations and sub-combinations described in the detailed description.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicant. In addition, the drawings may contain other marks owned by third parties and are being used for illustrative purposes only. All rights to various trademarks and copyrights represented herein, except those belonging to their respective owners, are vested in and the property of the Applicant. The Applicant retains and reserves all rights in its trademarks and copyrights included herein, and grants permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure. In the drawings.

DETAILED DESCRIPTION

Figure 1:
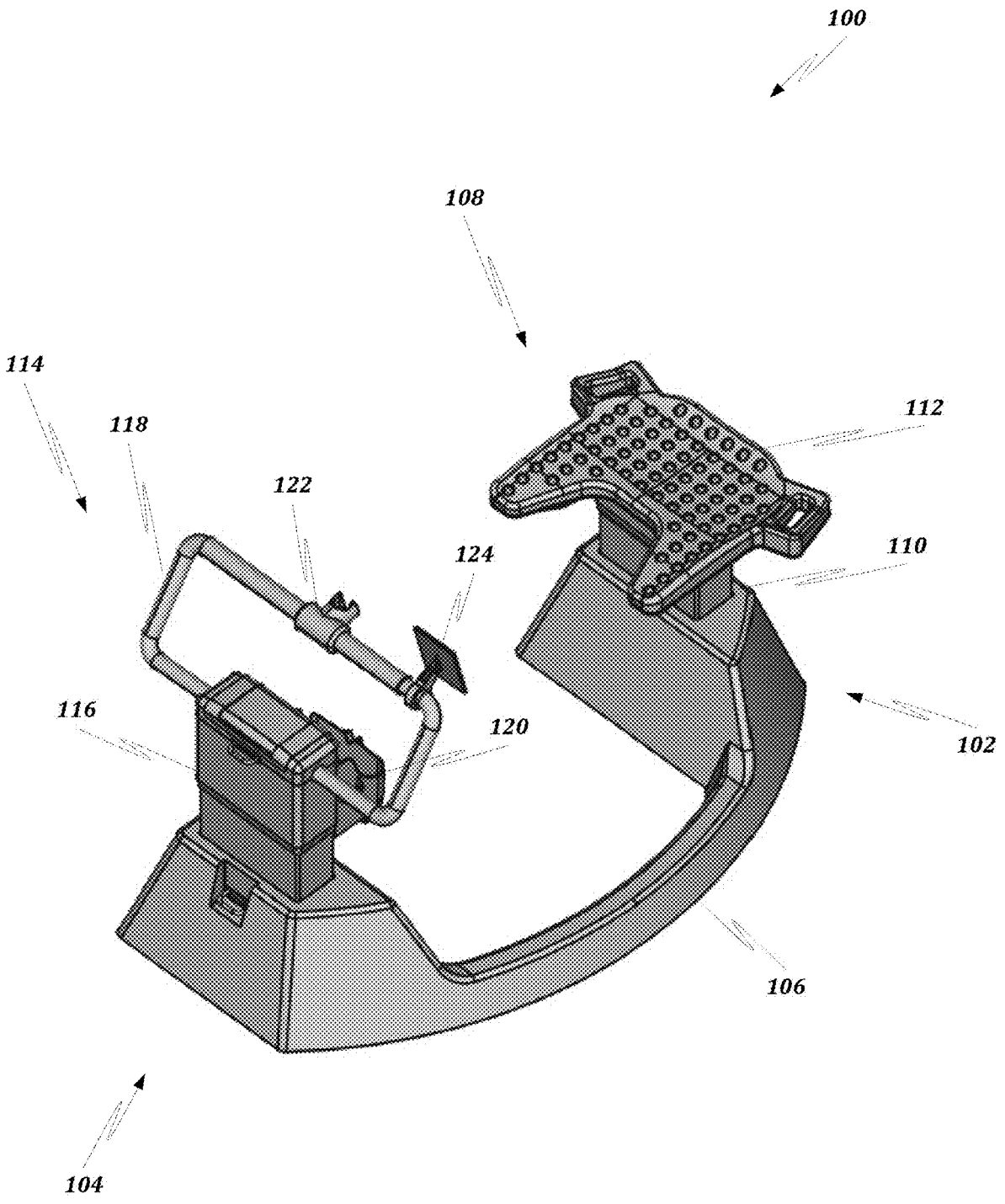
FIG. 1 is a perspective view of an adjustable shower assembly according to the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

The present disclosure can be understood more readily by reference to the following detailed description of the disclosure and the Examples included therein.

Before the present articles, systems, devices, and/or methods are disclosed and described, it is to be understood that they are not limited to specific manufacturing methods unless otherwise specified, or to particular materials unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present disclosure, example methods and materials are now described.

Moreover, it is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

Any and all publications mentioned herein are incorporated herein by reference to disclose and describe the methods and/or materials in connection with which the publications are cited.

Definitions

It is also to be understood that the terminology used herein is for the purpose of describing particular aspects only and is not intended to be limiting. As used in the specification and in the claims, the term "comprising" can include the aspects "consisting of" and "consisting essentially of." Unless defined otherwise, all technical and scientific terms used herein have the same meaning as commonly understood by one of ordinary skill in the art to which this disclosure belongs. In this specification and in the claims which follow, reference will be made to a number of terms which shall be defined herein.

As used in the specification and the appended claims, the singular forms "a," "an" and "the" include plural referents unless the context clearly dictates otherwise. Thus, for example, reference to "an assembly" includes two or more assemblies.

Ranges can be expressed herein as from one particular value, and/or to another particular value. When such a range is expressed, another aspect includes from the one particular value and/or to the other particular value. Similarly, when values are expressed as approximations, by use of the antecedent 'about,' it will be understood that the particular value forms another aspect. It will be further understood that the endpoints of each of the ranges are significant both in relation to the other endpoint, and independently of the other endpoint. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

As used herein, the terms "about" and "at or about" mean that the amount or value in question can be the value designated some other value approximately or about the same. It is generally understood, as used herein, that it is the nominal value indicated ±10% variation unless otherwise indicated or inferred. The term is intended to convey that similar values promote equivalent results or effects recited in the claims. That is, it is understood that amounts, sizes, formulations, parameters, and other quantities and characteristics are not and need not be exact, but can be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such. It is understood that where "about" is used before a quantitative value, the parameter also includes the specific quantitative value itself, unless specifically stated otherwise.

The terms "first," "second," "first part," "second part," and the like, where used herein, do not denote any order, quantity, or importance, and are used to distinguish one element from another, unless specifically stated otherwise.

As used herein, the terms "optional" or "optionally" means that the subsequently described event or circumstance can or cannot occur, and that the description includes instances where said event or circumstance occurs and instances where it does not. For example, the phrase "optionally affixed to the surface" means that it can or cannot be fixed to a surface.

Disclosed are the components to be used to manufacture the disclosed devices and articles of the disclosure as well as the materials themselves to be used within the methods disclosed herein. These and other materials are disclosed herein, and it is understood that when combinations, subsets, interactions, groups, etc. of these materials are disclosed that while specific reference of each various individual and collective combinations and permutation of these materials cannot be explicitly disclosed, each is specifically contemplated and described herein. For example, if a particular material is disclosed and discussed and a number of modifications that can be made to the materials are discussed, specifically contemplated is each and every combination and permutation of the material and the modifications that are possible unless specifically indicated to the contrary. Thus, if a class of materials A, B, and C are disclosed as well as a class of materials D, E, and F and an example of a combination material, A-D is disclosed, then even if each is not individually recited each is individually and collectively contemplated meaning combinations, A-E, A-F, B-D, B-E, B-F, C-D, C-E, and C-F are considered disclosed. Likewise, any subset or combination of these is also disclosed. Thus, for example, the sub-group of A-E, B-F, and C-E would be considered disclosed. This concept applies to all aspects of this application including, but not limited to, steps in methods of making and using the articles and devices of the disclosure. Thus, if there are a variety of additional steps that can be performed it is understood that each of these additional steps can be performed with any specific aspect or combination of aspects of the methods of the disclosure.

It is understood that the devices and systems disclosed herein have certain functions. Disclosed herein are certain structural requirements for performing the disclosed functions, and it is understood that there are a variety of structures that can perform the same function that are related to the disclosed structures, and that these structures will typically achieve the same result.

Turning now to FIG. 1, an adjustable shower assembly 100 is illustrated. The assembly 100 includes a first receptacle 102 and a second receptacle 104, joined by a spacing member 106. In embodiments, the assembly may be formed from a relatively strong, lightweight, and durable material that is resistant to corrosion in damp environments. As an example, plastic materials may be used to form the assembly 100.

In embodiments the adjustable shower assembly 100 may be removably installed into a bathtub or shower stall. For example, the adjustable show assembly may not be physically attached to the bathtub or shower stall, but may be held in place because the size of the adjustable shower assembly 100 matches a size of the bathtub. Alternatively, the adjustable shower assembly 100 may be attached to the bathtub or shower stall using temporary attachments, such as suction cups.

Each of the first receptacle 102 and the second receptacle 104 may be configured to receive and retain a corresponding assisting assembly. For example, as shown in FIG. 1, the first receptacle 102 is configured to retain an adjustable seat assembly 108. The adjustable seat assembly 108 may include an adjustable-height support tower 110 and a seat 112 attached thereto. The adjustable height support tower 110 may be configured to support bodyweight of a user. The adjustable height support tower may be adjustable between multiple heights to accommodate users of varying heights.

The seat 112 may be removably attached to the adjustable seat assembly 108. In embodiments, the seat may be a "tractor-style" seat as shown in FIG. 1. Alternatively, the seat may be a "toilet style" seat. There are a variety of seat styles that may be used with the adjustable seat assembly.

In embodiments, the seat 112 may be formed from a durable material that is capable of supporting a user's bodyweight and distributing the bodyweight to the adjustable height support tower 110. In some embodiments, the seat 112 may be formed from a brightly colored material. The bright color may be attractive to certain users, such as children and/or users with cognitive disorders, such as dementia and Alzheimer's disease. The bright colors may help to encourage users to interact with the seat by bathing regularly. Additionally, a brightly colored material may make the seat 112 more visible for users with poor vision. In particular, a brightly colored material may make the seat 112 more visible for visually impaired users who are not wearing corrective lenses (e.g., eyeglasses) because they intend to bathe or are currently bathing.

Figure 2:
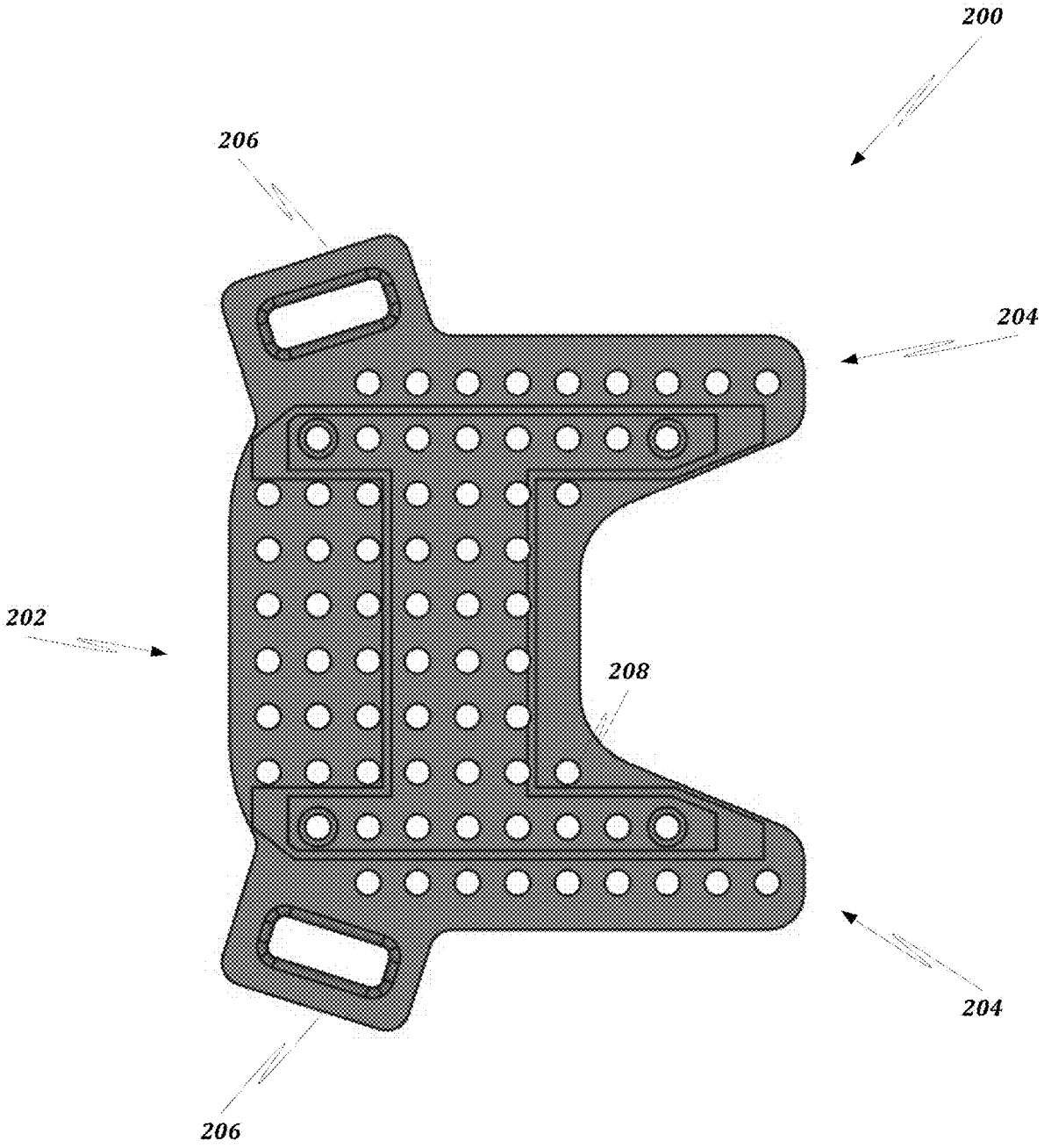
FIG. 2 is an overhead plan view of a seat for the shower assembly.

FIG. 2 illustrates a tractor-style seat 200 for use with the adjustable seating assembly 108. As shown in FIG. 2, the seat 200 may include a seat portion 202, optional leg extension portions 204, and one or more grips 206.

The seat 200 may define drainage holes 208. The drainage holes 208 may allow water to pass through, preventing pooling of water on the seat 200. In some embodiments, the drainage holes may also facilitate upward spray of water and/or cleanser from below the user, allowing for rinsing and cleansing of a user's undercarriage region while the user remains in a seated position.

The seat portion 202 is preferably shaped to accommodate a user sitting in the tractor-style seat 200. In some embodiments, the seat portion 202 may be substantially planar. Alternatively, the seat portion 202 may be contoured to complement the anatomical contours of a user in a seated position.

The optional leg extension portions 204 may be connected to the seat portion 202 to provide additional support to a seated user under the user's thighs. This additional support may help to stabilize a user. The leg extension portions 204 are preferably formed from the same materials as the seat portion 202. In embodiments, the leg extension portions 204 may be relatively flat and substantially coplanar with the seat portion 202.

In some embodiments, the seat portion 202 and optional leg extension portions 204 may be configured such that a user's undercarriage is not supported by the seat 200. In this way, the user may fully cleanse their lower body, including undercarriage, without need to stand.

The seat 200 may include one or more grips 206. As shown in FIG. 2, the seat 200 includes two grips 206, disposed on the sides of the seat 200. However, those of skill in the art will recognize that more or fewer grips 206 may be included without altering the scope of the disclosure. In embodiments, the grips 206 may be formed from a soft-touch material, such as plastic or rubber, and may help to facilitate user stabilization while the user is bathing. For example, a user may grip the seat at one of the grips 206 when bending to cleanse or rinse their lower body. The grips 206 may also facilitate installation of the adjustable-height seating assembly 108 into the adjustable shower assembly 100, to adjust a height of the seat relative to the shower floor, and/or to aid the user in mounting the seat 200.

Returning now to FIG. 1, the second receptacle 104 may be configured to receive and retain a handle assembly 114. The handle assembly 114 may include a support tower 116 and a handlebar 118. The handle assembly 114 may further optionally include a removeable basket 120.

The support tower 116 may be adjustable in height to accommodate users of differing heights, and may be configured to support bodyweight of a user. The support tower 116 may receive and retain the handlebar 118. In some embodiments, the support tower 116 may optionally be configured to removably retain the removeable basket 120.

The handlebar 118 may be a loop-type handlebar, as shown in FIG. 1. Alternatively, the handlebar 118 may be a bicycle style handlebar, or any other type of handlebar that is disposed in a location such that users can reach and grab the handlebar. There are a variety of useful handlebar styles. In embodiments, the handlebar 118 may be positioned such that, when a user is seated in the seat 112, the handlebar is disposed approximately at chest level. The chest level handlebar 118 may provide increased support and comfort for the user during use.

In embodiments, the handlebar 118 may be formed from a durable material that is capable of supporting at least a portion of a user's bodyweight and distributing the bodyweight to the support tower 116. Additionally, the material used to form the handlebar 118 is preferably a non-slip material that provides friction when gripped, even when the material is wet. For example, the handlebar 118 may be formed from a textured rubber or plastic material. In some embodiments, the handlebar 118 may be formed from a brightly colored material. The bright color may be attractive to certain users, such as children and/or users with cognitive disorders, such as dementia and Alzheimer's disease. The bright colors may help to encourage users to interact with the seat by bathing regularly. Additionally, a brightly colored material may make the handlebar 118 more visible for users with poor vision. In particular, a brightly colored material may make the handlebar 118 more visible for visually impaired users who are not wearing corrective lenses (e.g., eyeglasses) because they intend to bathe or are currently bathing.

In some embodiments, the handlebar 118 may define a mounting bracket 122 for use in receiving and retaining a showerhead, such as a handheld shower wand (not shown) to the adjustable assembly 100. The mounting bracket 122 may allow for the shower wand to be removably retained, and may hold the shower wand in place by a friction fit. The mounting bracket is preferably a C-shaped bracket that retains a handle of the handheld shower wand. In embodiments, the mounting bracket 122 is positioned at approximately chest height, relative to a user seated in the chair 112.

In some embodiments, a mirror 124 may be attached to the handlebar 118. For example, the mirror 124 may facilitate shaving, tweezing, plucking, or other hygienic and/or aesthetic activities normally performed using a mirror. The mirror 124 may be permanently or removably mounted to the handlebar 118. In some embodiments, the mirror may be formed from a plastic (e.g., polycarbonate) material with a reflective coating, a shatterproof glass material. The mirror 124 may include a hydrophilic coating, improving visual clarity of the mirror 124 by preventing condensation and causing moisture to spread into an even layer so the condensation does not form single mist droplets.

Figure 3A:
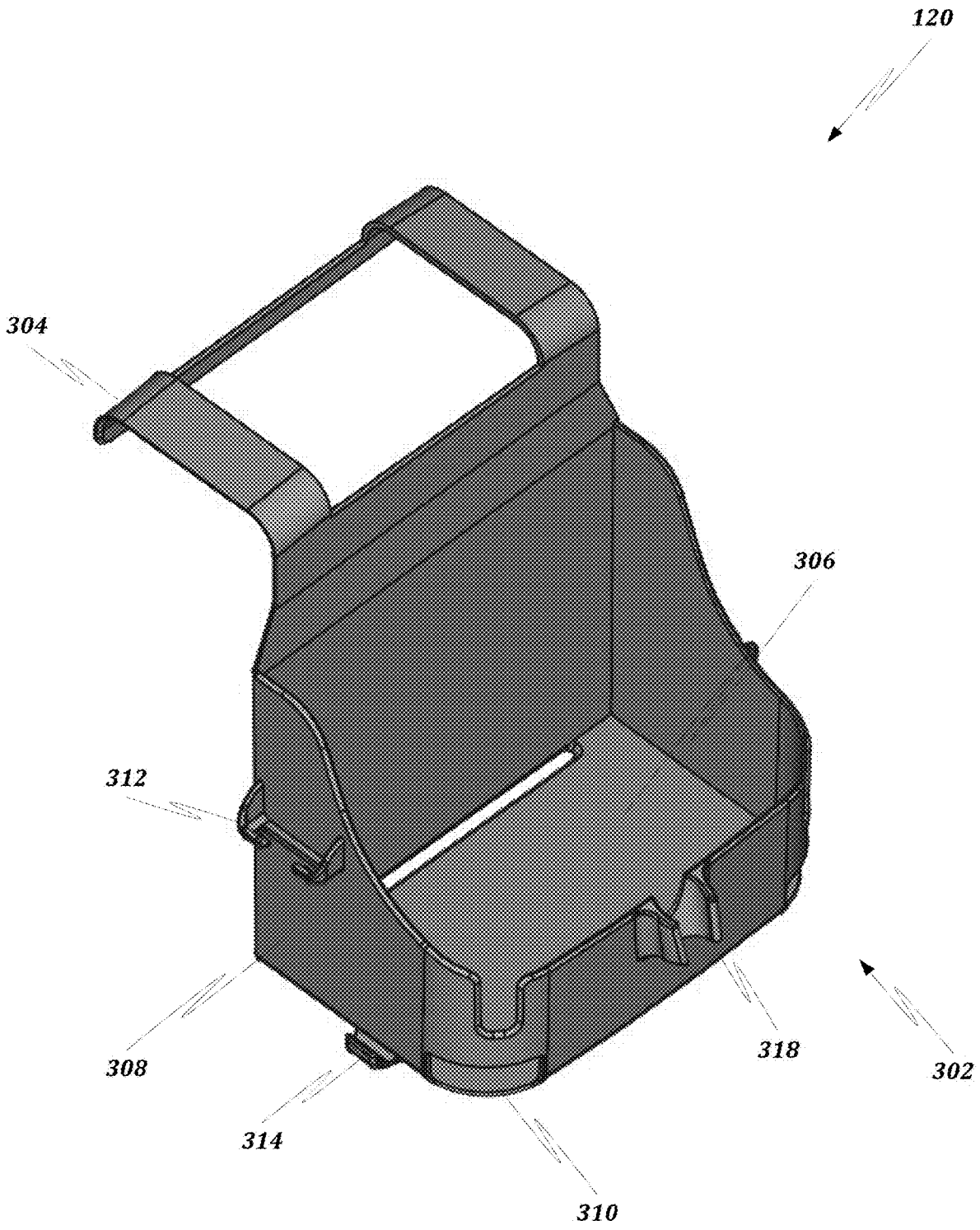
FIG. 3A is a perspective view of a basket for the shower assembly.
Figure 3B:
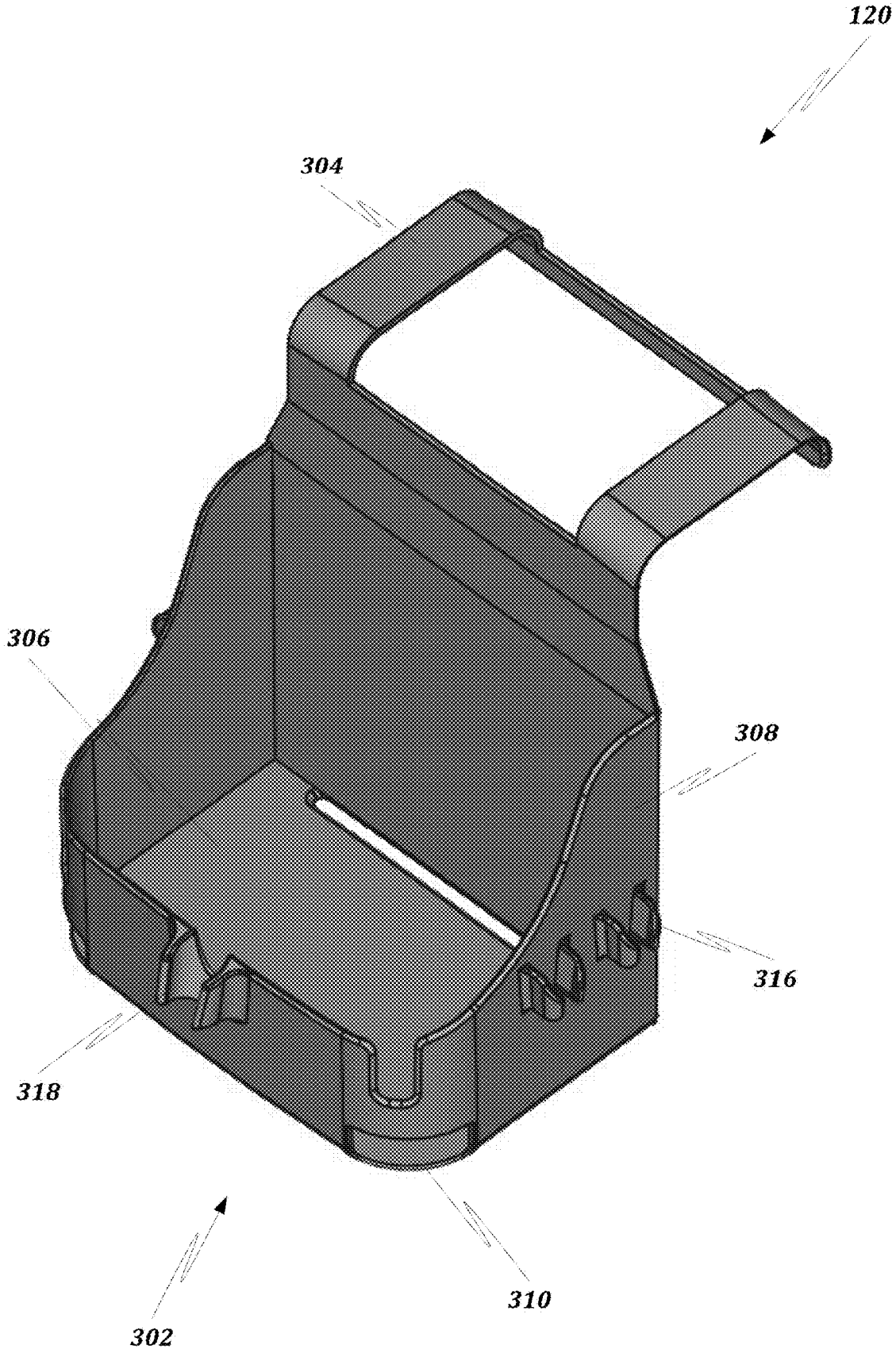
FIG. 3B is a second perspective view of the basket for the shower assembly.

In embodiments, the handle assembly 114 optionally includes a removeable basket 120. FIGS. 3A and 3B show a detailed view of the removable basket 120. The removable basket 120 may include a carrying basket 302 and a hanging support 304.

The carrying basket 302 may be dimensioned to receive and retain hygiene products, such as soap, body wash, shampoo, and the like. The carrying basket 302 may be formed from a rigid, non-corroding material, such as plastic. In embodiments, the carrying basket may include a substantially flat base 306 and vertical wall 308. The base 306 and/or wall 308 may define one or more drainage holes 310 to allow water to drain from the basket 302.

The wall 308 may further include various features for retaining additional hygiene and/or grooming products. For example, the wall 308 may include a razor holder 312 and/or a hook 314 for retaining an item with a hang cord, such as a loofah, sponge, or soap on a rope, as shown in FIG. 3A. As an additional example, the wall 308 may include holders 316 for retaining a toothbrush or other small hygiene products (e.g., flossers, dental picks, tweezers, etc.), as shown in FIG. 3B.

In some embodiments, the wall 308 may optionally include a mounting bracket 318 for receiving and retaining a showerhead, such as a handheld shower wand (not shown). The mounting bracket 318 may allow for the shower wand to be removably retained, and may hold the shower wand in place by a friction fit. The mounting bracket 318 is preferably a C-shaped bracket that retains a handle of the handheld shower wand. In embodiments, the mounting bracket 318 is positioned at approximately chest height, relative to a user seated in the chair 112.

The removable basket 106 may have a hanging support 304. The hanging support may extend from the wall 308. In embodiments, the hanging support 304 is generally U-shaped, and is configured to hang on the handle assembly 114. In some embodiments, the hanging support may be configured to hang from, for example, the handlebar 118 and/or the support tower 116. The hanging support may be formed from a rigid plastic material, or may be formed from a fabric material, such as a nylon webbing.

Returning now to FIG. 1, the first receptable 102 and the second receptacle 104 may be joined by a spacing member 106. In embodiments, the spacing member may be an elongate member that connects the first receptacle 102 and the second receptacle 104. In some embodiments, the spacing member 106 may be configured to maintain a predetermined particular distance between the first receptacle and the second receptacle, to allow for a user to enter a bathtub or shower stall into which the assembly 100 has been installed, and to give the user adequate room to mount and dismount the assembly 100. The spacing member 106 may be disposed along one side of the assembly 100 to facilitate entry and exit of the bathtub or shower stall without the spacing member being a tripping hazard. For example, the spacing member 106 may be disposed along a distal side of the bathtub or shower stall, away from the user entry point. In some embodiments, the spacing member 106 has an arcuate shape to allow for additional space in a footwell defined between the first receptacle 102 and the second receptacle 104.

Those of skill in the art will recognize that, while FIG. 1 illustrates the first receptacle 102 receiving and retaining the adjustable seat assembly 108 and the second receptacle 104 receiving and retaining the handle assembly 114, the adjustable seat assembly and handle assembly are each interchangeable. That is, the adjustable seat assembly 108 may be interchangeably mounted to either the first receptacle 102 or the second receptacle 104; the handle assembly 114 may be interchangeably mounted to the other of the first receptacle and the second receptacle. In this way, the assembly 100 may be configured to match the user needs and an existing bathtub or shower stall configuration.

In some embodiments, the shower assembly 100 may include additional modules to increase utility of the assembly. For example, the shower assembly 100 may include a pedal pusher (not shown) disposed in a footwell defined by the first receptacle 102 and the second receptacle 104. The pedal pusher may be used to facilitate exercise, either during bathing or outside of bathing times.

Claims

While the specification includes examples, the disclosure's scope is indicated by the following claims. Furthermore, while the specification has been described in language specific to structural features and/or methodological acts, the claims are not limited to the features or acts described above. Rather, the specific features and acts described above are disclosed as example for embodiments of the disclosure.

Insofar as the description above and the accompanying drawing disclose any additional subject matter that is not within the scope of the claims below, the disclosures are not dedicated to the public and the right to file one or more applications to claims such additional disclosures is reserved.

The following is claimed:

1. A shower assembly apparatus configured to be removably installed into a bathtub, the apparatus comprising:

a base comprising a first mounting point and a second mounting point, separated by a spacing member;

a seat assembly, including a first support tower configured to support bodyweight of a user and a seat that is configured to be attached to the first support tower; and a handle assembly including a second support tower and a handlebar configured to be attached to the second support tower;

wherein the seat assembly is configured to be removably mounted to a first one of the first mounting point and the second mounting point, and wherein the handle assembly is configured to be a second one of the first mounting point and the second mounting point.

2. The apparatus of claim 1, further comprising a basket mounted on the handle assembly.

3. The apparatus of claim 2, wherein the basket is removable from the handle assembly.

4. The apparatus of claim 1, wherein the first support tower is adjustable in height.

5. The apparatus of claim 1, wherein the seat comprises one or more grips.

6. The apparatus of claim 1, where the seat comprises two leg extension portions separated by a relatively flat seat portion, configured to permit access to a user's undercarriage.

7. The apparatus of claim 1, wherein at least one of the seat or the handlebar is formed from a high-visibility plastic.

8. A shower assembly apparatus configured to be removably installed into a bathtub, the apparatus comprising:

a base removably installed in the bathtub;

a seat mounted on the base at a first end of the bathtub; and a handle assembly mounted to the base at a second end of the bathtub;

wherein a spacing member of the base separates the seat and the handle assembly to define a footwell;

wherein the seat comprises a saddle-style seat.

9. The apparatus of claim 8, further comprising a basket mounted on the handle assembly.

10. The apparatus of claim 9, wherein the basket is removable from the handle assembly.

11. The apparatus of claim 9, wherein the basket includes a showerhead mount.

12. The apparatus of claim 8, wherein the handle assembly comprises a handlebar mounted on a support tower, such that the handlebar is positioned at approximately chest level of a user seated on the seat.

13. The apparatus of claim 12, wherein the handle assembly includes a mirror mounted on the handlebar.

14. The apparatus of claim 8, further comprising a pedal pusher disposed in the footwell.

15. A shower assembly apparatus configured to be removably installed into a bathtub, the apparatus comprising:

a main assembly removably installed in the bathtub, the main assembly having a first mounting point and a second mounting point separated by a spacing member;

an adjustable seat subassembly being configured for interchangeable mounting between the first mounting point and the second mounting point, the adjustable seat subassembly including an adjustable-height support tower and a seat configured to be attachable to the adjustable-height support tower;

a handle subassembly being configured for interchangeable mounting between the first mounting point and the second mounting point, such that the handle subassembly and the adjustable seat subassembly are mounted at different mounting points of the main assembly;

wherein the spacing member is positioned at a first side of a base of the main assembly, such that the spacing member is disposed at a distal side of the bathtub relative to a point of entry into the bathtub.

16. The apparatus of claim 15, wherein the spacing member defines a footwell between the first mounting point and the second mounting point, the apparatus further comprising a pedal pusher disposed in the footwell.

17. The apparatus of claim 15, wherein the seat comprises one or more grips.

18. The apparatus of claim 15, wherein the seat comprises two leg extension portions separated by a relatively flat seat portion, configured to permit access to a user's undercarriage.

19. The apparatus of claim 15, wherein the handle subassembly includes a second adjustable-height support tower and a handlebar attached to the second adjustable-height support tower.

20. The apparatus of claim 19, wherein at least one of the seat or the handlebar is formed from a high-visibility plastic.

* * * * *